US006457396B1

(12) United States Patent
Bean et al.

(10) Patent No.: US 6,457,396 B1
(45) Date of Patent: Oct. 1, 2002

(54) SELF PROPELLED GUN

(75) Inventors: Mervyn L Bean; Frederick Herbert; David A Eaglestone, all of Barrow in Furness (GB)

(73) Assignee: Bae Systems Marine Limited, Farnborough (GB)

( * ) Notice: Subject to any disclaimer, the term of this patent is extended or adjusted under 35 U.S.C. 154(b) by 0 days.

(21) Appl. No.: 09/806,906

(22) PCT Filed: Sep. 29, 1999

(86) PCT No.: PCT/GB99/03234

§ 371 (c)(1),
(2), (4) Date: Aug. 7, 2001

(87) PCT Pub. No.: WO00/22369

PCT Pub. Date: Apr. 20, 2000

(30) Foreign Application Priority Data

Oct. 8, 1998 (GB) ..... 9822010

(51) Int. Cl.[7] ..... F41A 27/00
(52) U.S. Cl. ..... 89/40.04; 89/40.01; 89/40.02
(58) Field of Search ..... 89/40.02, 40.03, 89/40.04, 40.01, 40.11, 40.12, 40.15

(56) References Cited

U.S. PATENT DOCUMENTS

| | | | | |
|---|---|---|---|---|
| 4,317,405 A | * | 3/1982 | Ebner et al. | 89/40.04 |
| 4,791,852 A | * | 12/1988 | Fraud et al. | 89/40.02 |
| 4,945,813 A | * | 8/1990 | Moscrip et al. | 89/40.01 |

FOREIGN PATENT DOCUMENTS

| | | |
|---|---|---|
| DE | 22 51 846 | 5/1973 |
| DE | 22 32 567 | 1/1974 |
| DE | 195 10 213 | 9/1996 |
| EP | 0 066 161 | 12/1982 |
| EP | 0 663 583 | 7/1995 |
| FR | 2 663 727 | 12/1991 |
| GB | 2 313 178 | 11/1997 |
| WO | WO 97/48959 | 12/1997 |
| WO | WO97/48959 | 12/1997 |

* cited by examiner

*Primary Examiner*—J. Woodrow Eldred
(74) *Attorney, Agent, or Firm*—Nixon & Vanderhye P.C.

(57) ABSTRACT

A self propelled gun (2) comprises a vehicle (4) possessing a source of primary power (6) and a gun assembly (8) movably attached to the vehicle. The gun assembly (8) comprises a base (10), a cradle (14) pivotally mounted to the base and a barrel (16) slidably mounted to the cradle (14) such as to be displaceable from a first, run-out, position to a second, recoiled, position as a consequence of the barrel (16) recoiling on firing. The gun assembly (8) is movably mounted to the vehicle (4), preferably by a pivot arrangement (24, 26) between vehicle (4) and base (10), such that in a first, "mobility", mode the gun assembly (8) is free of any direct contact with the ground (42), and said barrel (16) points in a first direction allowing said vehicle (4) to be driven and a second, "firing", mode of operation in which the gun assembly is deployed to a firing position in which the base moves towards and into engagement with the ground (42). During deployment of the gun assembly (8) the barrel (16) is deployable through an angle of elevation which differs from said first direction by at least ninety degrees.

9 Claims, 6 Drawing Sheets

SELF PROPELLED GUN

BACKGROUND OF THE INVENTION

1. Field of the Invention

This invention relates to a self propelled gun.

2. Discussion of Prior Art

Mobility is a key factor in modern warfare and for any piece of artillery to play a valuable part on the battlefield it must be able rapidly to reach the scene of conflict, that is it must be able rapidly to be tactically deployed. Although there is a wide range of field artillery such as tanks, self propelled howitzers and guns, towed field howitzers and guns and self propelled mortars, each has its own weaknesses in rapid deployment scenarios.

Tanks, for example, are heavy (50–60 Tonnes), well armoured tracked vehicles with a turret mounted medium calibre gun (105–140 mm) which are generally used on line of sight, short range engagements. Although a single tank can be transported by the heaviest lift aircraft, such aircraft are restricted by the availability of suitable landing sites and therefore tanks can only be strategically deployed by air and have to be transported by ship, rail or under their own power to the scene of conflict which can be many thousands of kilometers from such a landing site. Furthermore whilst readily mobile once on the battlefield, they are incapable of carrying substantial amounts of ammunition.

Self propelled howitzers are heavy (30–60 Tonnes), relatively lightly armoured tracked vehicles with a medium calibre gun (typically 155 mm) which is often turret mounted. Generally this armament is deployed well behind the front line as an indirect fire weapon with barrel elevations of between −5° and 70° and has a range of up to 40 kilometers. As with tanks transporting this type of armament by air is impractical and deployment to a conflict must rely on ships, trains or their own mobility.

Self propelled guns are medium weight multi-wheeled or tracked vehicles having a medium calibre gun mounted on the rear of the vehicle. To assist in absorbing some of the energy when the gun is fired it is known for them to include one or more deployable spades at the rear of the vehicle which is/are lowered into engagement with the ground before firing.

Field howitzers and guns weigh up to 10 Tonnes and are an unarmoured indirect fire weapon, with a calibre up to 155 mm and a range up to 30 km. They can also be employed in a direct fire mode. Although some designs can have an auxiliary power unit (APU) giving very limited mobility on the battlefield they are normally towed by a lorry to, and around, the battlefield. Whilst air transportable by a fixed wing aircraft or helicopter, they are reliant upon lorries which also have to be transported to the battlefield for supplying them with ammunition.

A self propelled mortar is a relatively heavy (25–30 tonnes) lightly armoured tracked vehicle with a large calibre (240 mm) mortar. Generally they are an indirect fire weapon which is used at high elevation angles (45° to 80°) and has a range of 10 km or 18.0 km with rocket assistance. In contrast to other types of artillery described the barrel has a smooth bore (not rifled) and is not trunnion mounted. As with tanks and self propelled howitzers this type of armament is not practical to deploy by air.

SUMMARY OF THE INVENTION

The inventors have appreciated that a need exists therefore for an air transportable, high mobility, medium calibre self contained weapon. The present invention has arisen in an endeavour to provide a such a weapon which, in part at least, overcomes the limitation of the known guns.

According to the present invention a self propelled gun comprises: a vehicle possessing a source of primary power and a gun assembly, said gun assembly comprising a base; a cradle pivotally mounted to the base and a barrel slidably mounted to the cradle such as to be displaceable from a first to a second position as a consequence of the barrel recoiling on firing characterised in that the gun assembly is movably mounted to the vehicle such that in a first, "mobility", mode the gun assembly is free of any direct contact with the ground, and said barrel points in a first direction allowing said vehicle to be driven and a second, "firing", mode in which the gun assembly is deployed to a firing position in which the base moves towards and into engagement with the ground and wherein said barrel is deployable through an angle of elevation which differs from said first direction by at least ninety degrees.

A particular advantage of the self propelled gun of the present invention is that since the base is in contact with the ground during firing the effective height of the pivot about which the cradle and barrel are mounted, that is the height above the ground, is minimised which reduces the effect of overturning forces making the gun more stable in operation. In contrast to the known self propelled guns the vehicle of the present invention does not carry the full shock load during firing and this enables the use of a comparatively lighter weight vehicle having a standard suspension arrangement.

Advantageously the first direction is in a substantially horizontal forward direction such that when the gun assembly has been deployed to the "firing" mode the barrel is directed in a direction which is vertical or substantially away from the vehicle. This provides the additional advantages that:

(i) the vehicle acts as a virtual trail leg in that it increases the mass inertia of the gun assembly and helps counter the overturning moment of the recoil force, especially when firing at low angles of barrel elevation thereby eliminating the need for a deployable spade or trail legs; and (ii) since the barrel is directed away from the vehicle it is capable of operating through a large range of barrel elevations from a small angle of depression to a high angle of elevation without the vehicle obstructing the gun assembly.

Preferably the first direction is additionally substantially coincident with the axis of the vehicle and the barrel is swung vertically upwards during deployment. This allows the sides of the vehicle deck to be used for storage of a substantial number of shells and charges, crew accommodation and auxiliary equipment thereby enabling the self propelled gun to operate as a self contained unit.

Preferably the gun assembly is movably mounted to the vehicle by the base being pivotally attached to the vehicle by a pivot arrangement. In a particularly preferred arrangement the pivot arrangement is configured such that deployment of the base into engagement with the ground raises a part of the vehicle in proximity with the pivot arrangement away from the ground. This is particularly advantageous since a proportion of the vehicle's weight bears down through the pivot arrangement onto the base to assist in holding the gun assembly securely in contact with the ground when the gun is positioned and fired.

The barrel can be of normal or extended length (long range). Advantageously the barrel is held in the second position, i.e. in a fully recoiled position, during the "mobility" mode to reduce the overall length of the self propelled gun and any overhang of the barrel beyond the vehicle. This is particularly advantageous in that it assists in providing unobscured driver vision and is of additional benefit when the gun is being transported by air where space is at a premium. Thus, in practice, after the last round has been fired, the barrel is held in the fully recoiled position. Preferably the barrel is held in the second position when deploying the gun assembly from the "mobility" to "firing" mode and vice versa. This has the further advantage that the centre of gravity of the barrel is shifted towards the trunnion bearing thus reducing the out of balance of the gun assembly during deployment and/or stowage which reduces the duty on the means for deploying the gun assembly. This is especially so when deploying the gun assembly with the vehicle on, and disposed transversely to, an inclined surface.

In a particularly preferred embodiment the cradle is pivotally mounted about a bearing which is positioned beyond the maximum point of recoil of the barrel thereby minimising the bearing height whilst still enabling the barrel to be elevated to high angles of elevation.

Advantageously the base incorporates one or more spades, which conveniently comprises one or more rearwardly angled blades on the underside of the body, which is/are such as to dig into the ground during recoil thereby enhancing the transmission of the recoil forces to the ground.

BRIEF DESCRIPTION OF THE DRAWING

For a clearer understanding of the invention a self propelled gun in accordance with the invention will now be described, by way of example only, with reference to the accompanying drawings in which.

DETAILED DESCRIPTION OF THE DRAWING

Figure 2:
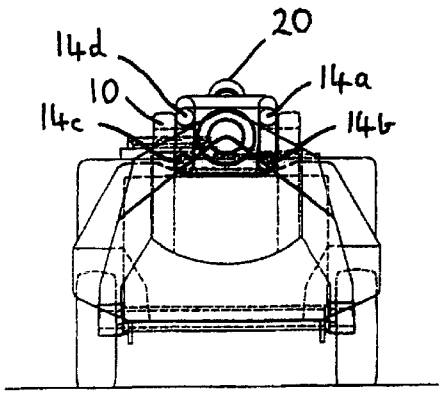
FIG. 2 is a front elevation of the self propelled gun of FIG. 1.

Referring to FIGS. 1 to 6 there is shown a self propelled (SP) gun or howitzer 2 in accordance with the invention in a "mobility" mode, that is a mode for travelling to and from a point of firing. The SP gun 2 comprises a multi-wheeled vehicle 4 having a primary source of power 6 and a gun assembly 8 movably mounted to the rear of the vehicle 4. The vehicle 4 preferably comprises an all wheel drive vehicle such as a 10×10. It will be appreciated however that other chassis configurations or tracked vehicles can also be used.

The gun assembly 8 comprises a base 10, a saddle (or trunnion support structure) 12, a cradle 14 and a barrel 16. The barrel 16, which preferably comprises a 52 calibre 155 mm rifled bore barrel, is slidably mounted to the cradle 14 such as to be displaceable from a first, run out or firing, position to a second, recoiled, position as a consequence of the barrel 16 recoiling on firing. A hydro-pneumatic recoil buffer and recuperator system (not shown) is provided to absorb some of the energy when the barrel 16 recoils during firing. It will be appreciated that other types of energy absorbing systems can be utilised such as for example hydraulic, mechanical spring, electro-magnetic brake or electro-rheological devices.

In a particularly preferred implementation the cradle 14 is constructed from hollow members preferably in the form of four lightweight tubes 14*a*–14*d* (as shown in FIG. 2) and the volume within the tubes is utilised to store the compressed gas for the hydro-pneumatic recuperator/buffer as is described in our UK patent GB 2313180, the content of which is hereby incorporated by way of reference thereto. A particular advantage of utilising the hollow cradle members to store the compressed gas is that this eliminates the need to use separate gas storage accumulators which reduces the weight of the gun assembly 8.

Figure 4:
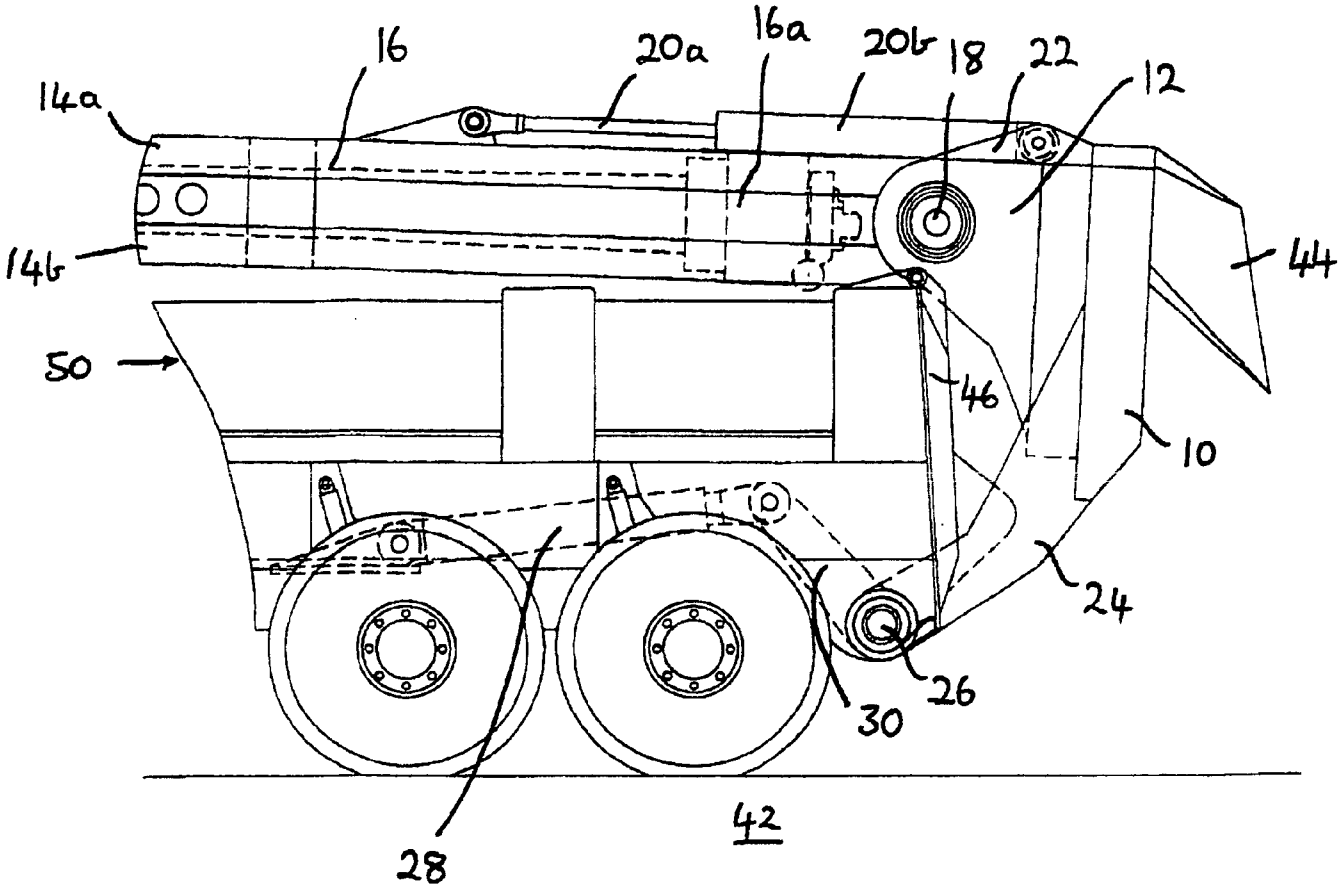
FIG. 4 is a schematic representation of the connection between the gun assembly and the vehicle in the "mobility" mode.

The cradle 14 has a pair of journals projecting coaxially from opposite sides which are pivotally mounted in a respective trunnion bearing 18 in the saddle 12 such that the barrel 16 can be elevated from low angles of depression e.g. −5° to high angles of elevation e.g. +70°. The barrel 16 is preferably slidably mounted within the cradle 14 such that the axis of the trunnion bearing is located substantially at, or beyond, the maximum point of recoil of the barrel 16 as described in our UK patent GB 2313178, the content of which is hereby incorporated by way of reference thereto. That is the barrel 16 is mounted in a forward position within the cradle 14 such that the breech 16A of the barrel does not pass through the axis of the trunnion bearing as a consequence of recoil on firing of the gun assembly 8. This is best illustrated in FIG. 4 which shows the barrel secured in a fully recoiled position. This is particularly advantageous in that it allows the height of the trunnion bearing 18 to be minimised whilst still allowing the barrel 16 to be elevated to high angles of elevation and thereby reduces the overturning moments on the saddle 12 during firing. Since the barrel does not recoil through the axis of the trunnion bearing, the cradle can be pivotally mounted to the saddle 12 by a solid axle rather than a trunnion mounting in alternative embodiments.

A pair of hydraulic elevating servo-actuators 20 are provided on opposite sides of the cradle 14 to elevate the barrel 16 to a desired elevation. Each hydraulic elevating actuator 20 comprises a piston 20A and cylinder 20B in which the piston 20A is pivotally attached to the cradle 14 and the cylinder 20B is pivotally attached to a respective part 22 of the saddle 12. Hydraulic power to operate the elevating actuators 20 is derived from the vehicle's primary power source 6, which can be supplemented using scavenged energy from the buffer/recuperator system. Activation of the hydraulic elevating actuators 20 causes their length to extend or contract thereby elevating the barrel 16. Whilst it is preferred to use hydraulic elevating servo-actuators other forms of actuators can be used such as electric rotary or linear servo motors.

The saddle 12 is pivotally mounted to the base 10 by a training bearing (not shown) to allow training of the gun assembly 8 over an arc of approximately ±30°. Extending from and fast with the base 10 are a pair of connecting members 24 for pivotally attaching the gun assembly 8 to the rear of the vehicle 4 about a bearing 26. The bearing 26 is located close to the vehicle's transmission height. The gun assembly 8 is movable about the bearing 26 by means of a hydraulic actuator 28 which comprises a piston 28A and cylinder 28B arrangement. The piston 28A is pivotally attached to a respective lever member 30 which is fast with the member 24 and the cylinder 28B is pivotally attached to the vehicle 4. The lever member 30 and connecting members 24 are configured such that an extension or contraction in the length of the actuator 28 causes the base 10 to pivot about the bearing 26.

Primary power is provided from pack 6 to drive the vehicle 4 as well as to deploy and operate the gun assembly 8. The vehicle 4 has cabs 32 and 34 for the crew which are isolated from respective shell 36 and charge 38 magazines which are located along the side of the vehicle deck. The magazines 36, 38 are divided into active (automatic loading) 36A, 36B and passive fixed containers 36B and 38B. Each active magazine 36A, 36B is respectively capable of typically holding forty-five shells and charges whilst the two passive magazines can each hold a further fifteen rounds. It will be appreciated that the total amount of ammunition (shells and charges) and the ratio of the active passive storage can be tailored to suit a given application. As illustrated the magazines 36, 38 lie within the vehicle chassis walls along the length of the vehicle and are separated by a central access corridor 50. The sidewalls of the charge magazine 38 provide physical isolation of the shells and charges. An automatic ammunition handling system (not shown) is provided for automatically loading the charges and shells at a typical minimum rate of eight rounds per minute. The ammunition handling system preferably comprises a walking-beam arrangement for each active magazine for moving the shells and charges within the magazines to the rear of the vehicle 4 and one or more mechanical arms for transferring them onto a loading tray for automatic ramming. The SP gun 2 of the present invention is thus a totally self contained unit.

Figure 3:
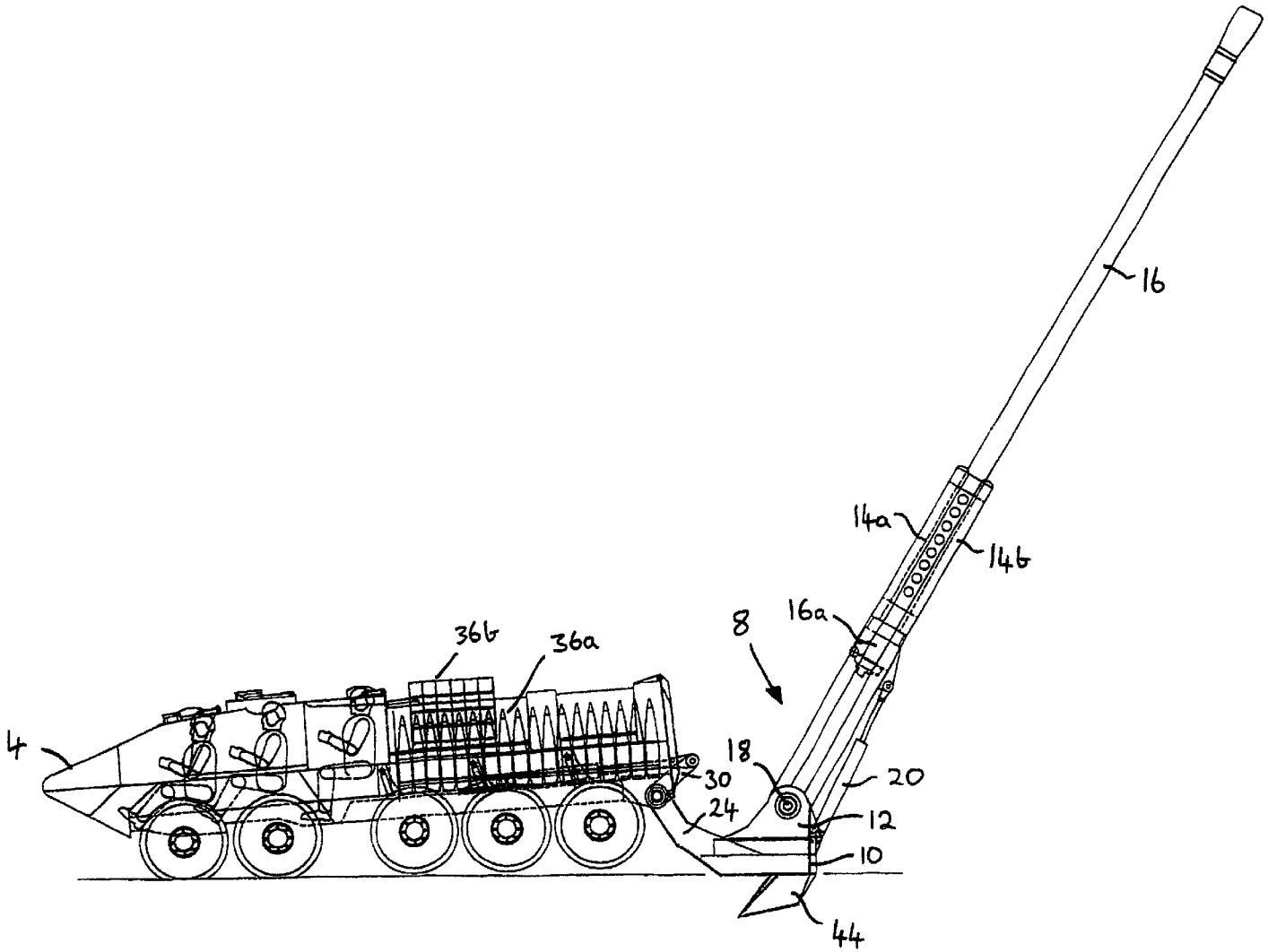
FIG. 3 is a side elevation of the self propelled gun of FIG. 1 in a "firing" mode.

FIG. 3 shows the SP gun 2 in a "firing" mode in which the gun assembly 8 is deployed and the base 10 engages the ground 42. A spade 44 which is detachably fastened to the underside of the base 10 is shown dug into the ground 42. The spade 44 is preferably in the form of one or more rearwardly angled chevron blades which is/are designed to dig into the ground 42 and to transmit the forces during firing. In the "firing" mode a part of the vehicle 4 adjacent to the gun assembly 8 is lifted such that a part of the weight of vehicle 4 bears down through the bearing 26 onto the base 10 to assist in holding the gun assembly 8 securely in contact with the ground 42. At the angle of elevation shown in FIG. 3 and high elevation angles, i.e. +30° to +70°, the majority of the recoil force is directed vertically and is transmitted into the ground 42 via the base 10. At low angles of elevation and at angles of depression i.e. +30° to −5°, the majority of the recoiling force induces an overturning moment about the spade which is absorbed wholly or in part by the mass of the vehicle 4 which thus acts as a virtual trail leg. The location of the trunnion bearing 18 beyond the limit of maximum recoil, gives the gun assembly 8 a high degree of positive out-of-balance and this is of most benefit at low angles of elevation where the out-of-balance turning moment will act to drive the spade 44 into the ground. The result is that, when fired, the angled blade 44 acts as a static plough to absorb a substantial part of the recoil forces such that only a minority is transferred to the vehicle 4.

Figure 5:
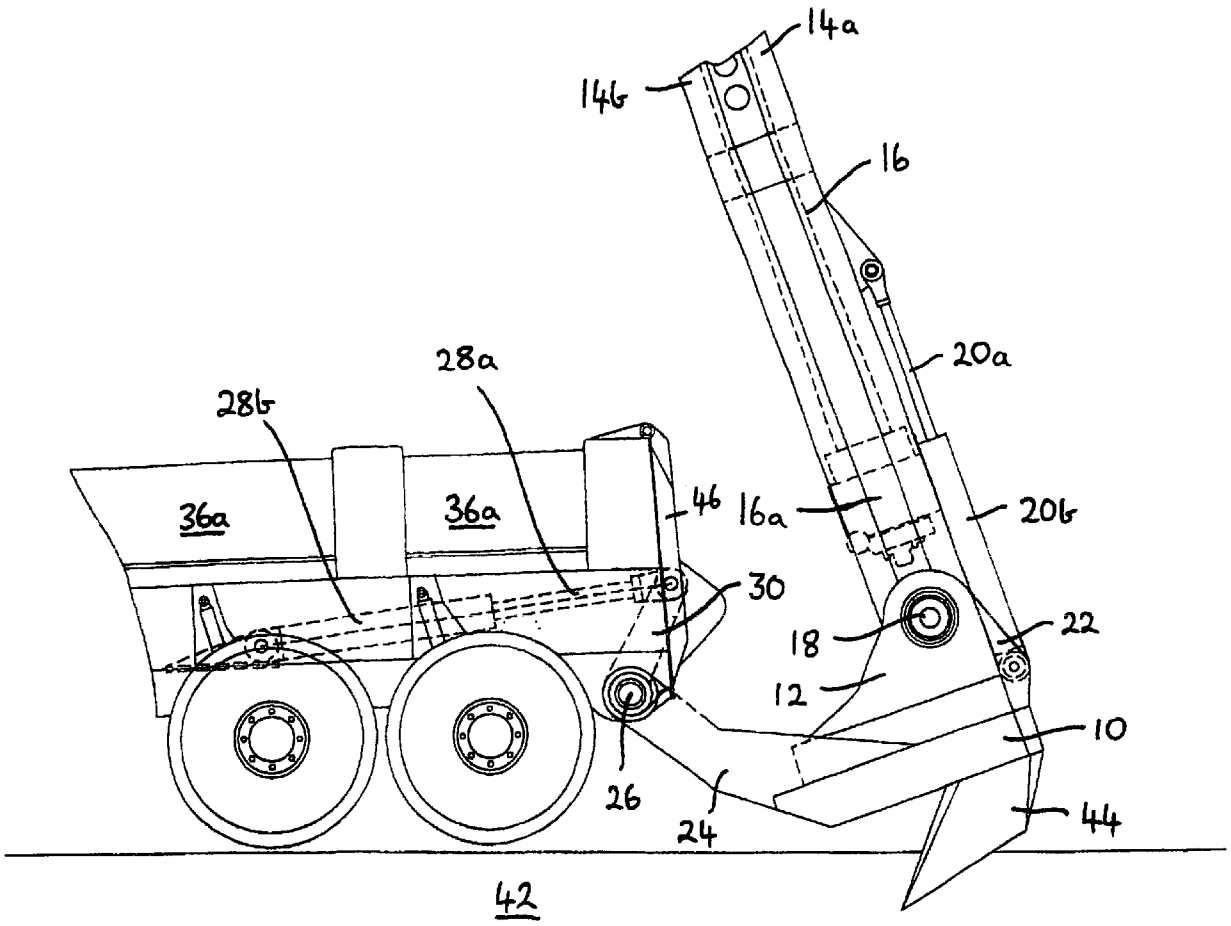
FIG. 5 is a schematic representation of the connection of FIG. 4 between "mobility" and "firing" modes.
Figure 6:
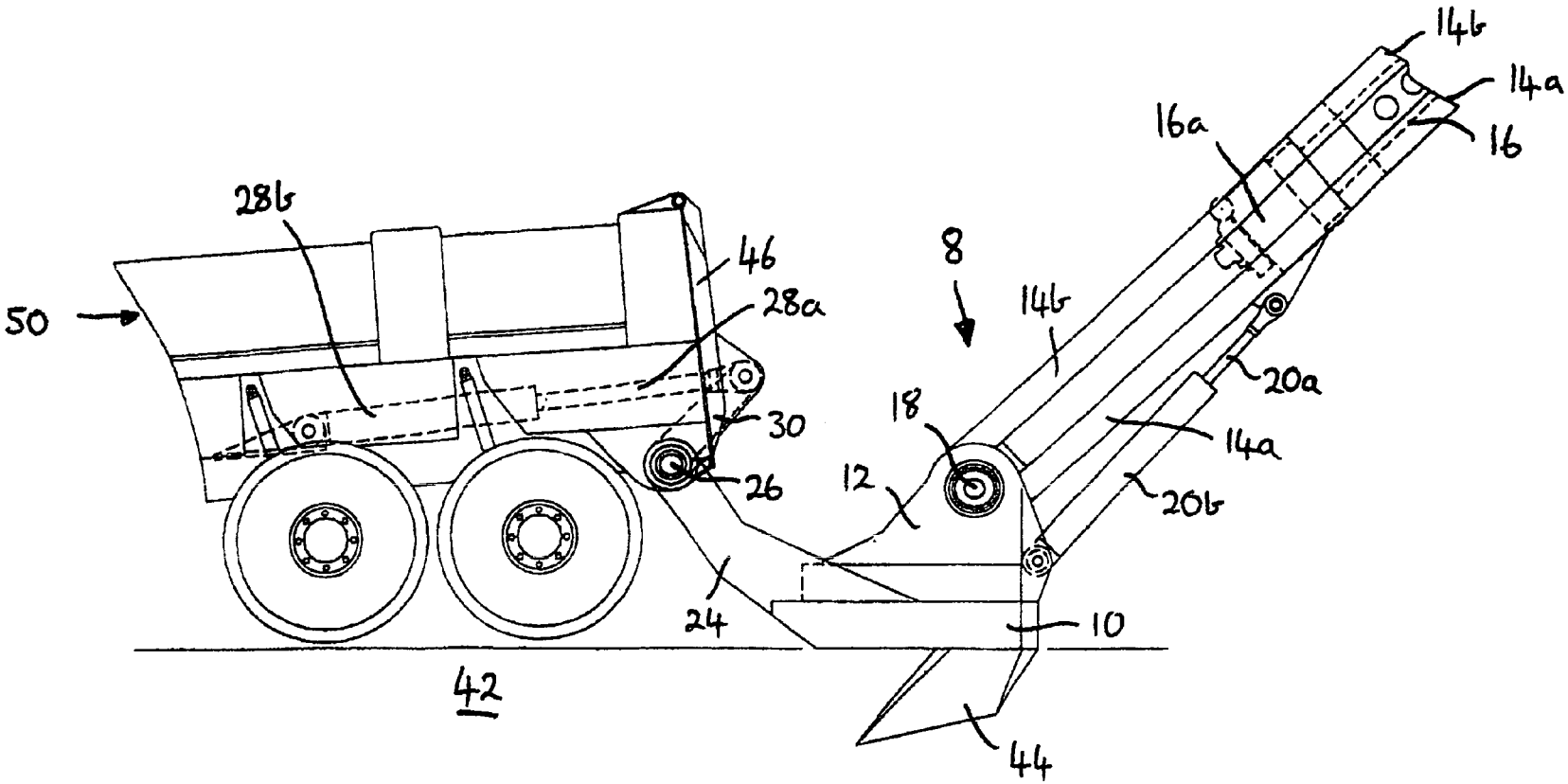
FIG. 6 is a schematic representation of the connection of FIG. 4 in the "firing" mode.

FIGS. 4, 5 and 6 show the principle of the deployment of the gun assembly 8 between the "mobility" and "firing" modes. Referring to FIG. 4, this shows the gun assembly 8 in the "mobility" mode in which the gun assembly 8 is free of any direct contact with the ground 42 and the barrel 16 is stowed in a substantially horizontal forward pointing direction. In the "mobility" mode the base 10 is pivoted into a substantially vertical orientation. A door 46 is provided on the end of the corridor 50 between the shell and charge magazines 36, 38.

To deploy the gun assembly 8 the hydraulic actuator 24 is activated such that the base 10 pivots about the bearing 26 from a substantially vertical orientation to a substantially horizontal orientation, at which point it is in engagement with the ground 42 as shown in FIG. 5. The position of the bearing 26 above the ground and the connecting member 24 are configured such that deployment of the gun assembly 8 drives the spade 44 into the ground 42 and raises the rear of the vehicle 4 away from the ground 42. At this point of the deployment the barrel 16 is in a substantially vertical elevation. The hydraulic actuator 20 is then activated to deploy the barrel 16 to a desired firing elevation as shown in FIG. 6.

In the "firing" mode the barrel 16 is directed either substantially vertically or away from the vehicle 4. During deployment of the gun assembly 8 the barrel 16 traverses an angle of at least 90° such that it is directed away from the vehicle 4. This enables the gun assembly 8 to be operated with depressed angles of elevation of the barrel 16 without the vehicle obstructing the gun assembly 8. It will be appreciated that in the "firing" mode the SP gun 2 effectively has a three point support, i.e. the base 10 and the sets of wheels near the front of the vehicle 4.

To deploy the gun assembly 8 from the "firing" to the "mobility" mode the reverse of the above procedure is used i.e. the barrel 16 is elevated to a substantially vertical elevation by activation of the actuator 20 and the whole gun assembly 8 is pivotally lifted clear of the ground 42 and into a stowed position within the vehicle 4 by activating actuator 24. To reduce the turning moment required by the actuators 20 and 24 the gun assembly 8 is preferably stowed with the barrel 16 in a fully recoiled position such that the centre of gravity of the barrel 16 is moved toward the trunnion bearing 18. Stowing the barrel 16 in this way is also advantageous as it reduces the overall length of the SP gun 2 and any overhang of the barrel beyond the vehicle, which assists in providing un-obscured driver vision and is of benefit when the gun is to be transported by air. Preferably the barrel 16 is clamped in place when in the "mobility" mode.

Whilst it is preferred to operate the hydraulic actuators 20, 24 in the order described this is not essential. In an alternative arrangement the actuators 20 and 24 can be operated simultaneously which would reduce the time taken to deploy the gun assembly 8 between the "mobility" and "firing" modes. However deploying the gun assembly 8 in two stages provide the following advantages. By firstly moving gun assembly 8 into a vertical position (FIG. 5), the centre of gravity of the elevating mass is effectively moved closer to the trunnion bearing 18, rather than to the right of it as shown in FIG. 3. This considerably reduces the turning moment needed to be generated by the hydraulic actuator 24. Secondly, after firing a few rounds the spade 44 will be embedded in the ground 42 and, in muddy conditions, the blade 46 and the underside 10A of base 10 may be held by a suction force. A larger turning moment will therefore need to be generated by the actuator 24 to break the suction between base 10/spade 44 and the ground 42. It is quite possible that the suction force could be of a significant magnitude compared to the weight of the gun assembly 8. Thus, it is preferred that the barrel 16 is moved to the vertical position (FIG. 5) before operating the hydraulic actuator 24. In order to assist the lifting effort of the actuators 24 the vehicle 4 can be driven slightly forwards and/or backwards to help to break the suction.

It will be appreciated that the actuator 24 has to be designed for a very considerable duty, including a necessary margin of reserve to cover the exigencies which might occur on a battlefield, e.g. emergency operation of the actuator 24 before operating the actuators 20 have fully completed their motion to bring the cradle 14 and barrel 16 to the vertical for rapid escape.

The SP gun 2 of the present invention is designed to be air transportable and therefore minimising weight is a prime consideration. Since the recoil of a 155 mm gun is a violent process it is advantageous to utilise every means to dissipate these forces. In a particularly preferred implementation a pressure relief valve is incorporated into the hydraulic elevating actuators 20 to allow limited rotational movement of the base 10 about the bearing 26 during firing. Conveniently this valve is in the form of a hydraulic switch which is operable to open when subjected to high impulses of force as would be experienced during firing and to close at normal operating forces. This limited freedom of movement allows the spade 44 to dig in more deeply and protect the actuator 20 and mounting members from damage. The hydraulic actuators 20 thus provide an element of selective damping to cushion the worst of the recoil forces. As the effect of the recoil and rebound ends, automatic hydraulic systems re-energise the actuators 20 to re-establish the firing attitude, i.e. urge the base 10 firmly into engagement with ground 42 and raise the rear of the vehicle 4.

Figure 1:
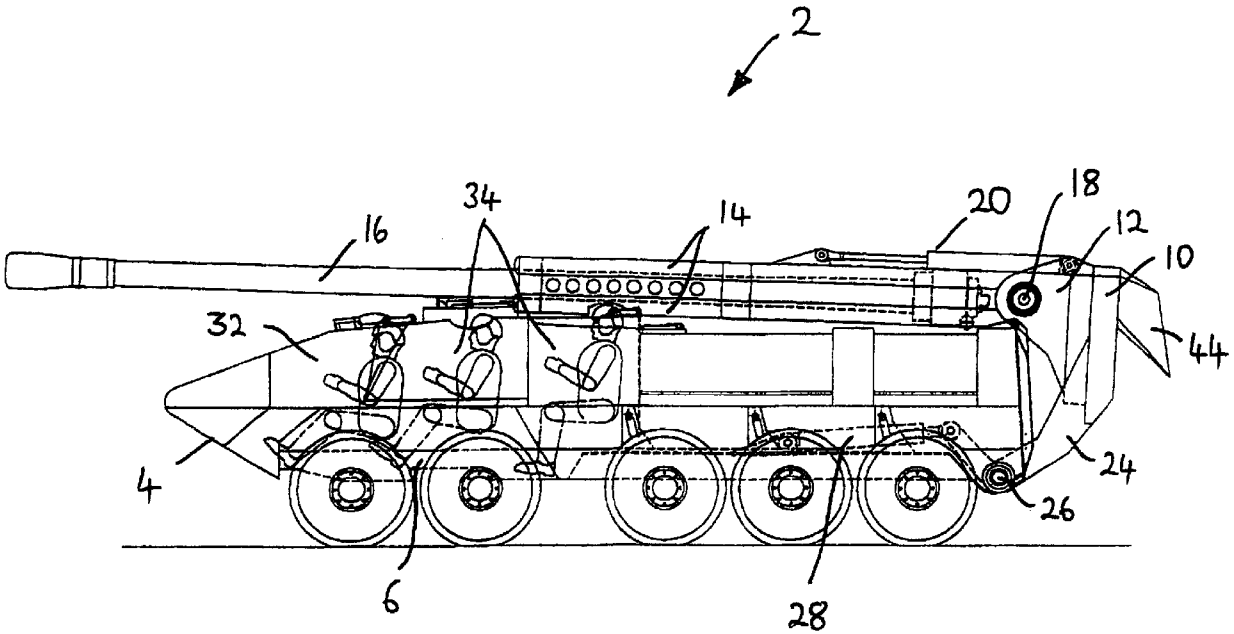
FIG. 1 is a schematic side elevation of a self propelled gun in accordance with the invention in a "mobility" mode.

As shown in FIGS. 1 and 3 the shell and charge magazines 36, 38 are located near the rear of the vehicle 4 such that their weight additionally urges the base 10 downward into engagement with the ground 42 thereby assisting in stabilising the gun assembly 8 during firing. Furthermore, since shells and charges 36, 38 are automatically moved towards the rear of the vehicle 4 each time a round is fired, this ensures that the maximum possible amount of weight acts to stabilise the gun assembly 8. This being said it will be appreciated that the SP gun of the present invention is designed for stable operation even without ammunition on board and that the effect therefore of the ammunition further assists in stabilising the gun assembly.

In the "mobility" mode, as shown in FIGS. 1 and 2, the barrel 16 rests on the roof of the corridor 50.

In operation of the SP gun 2 a target's position would be given and the co-ordinates of the firing position fed into an onboard gunnery computer which calculates the range and bearing of the target. Using an on-board navigation system the vehicle 4 is driven to the firing position and is oriented in a direction facing directly away from the target. The gun assembly 8 is deployed into the "firing" mode, such that it is pointing towards the target, and a number of rounds can be fired in rapid succession at different trajectories such that the rounds arrive at the target at substantially the same time. The gun assembly 8 is immediately swung back into the "mobility" mode and the vehicle moved to another location to reduce any likelihood of retaliation.

Figure 7:
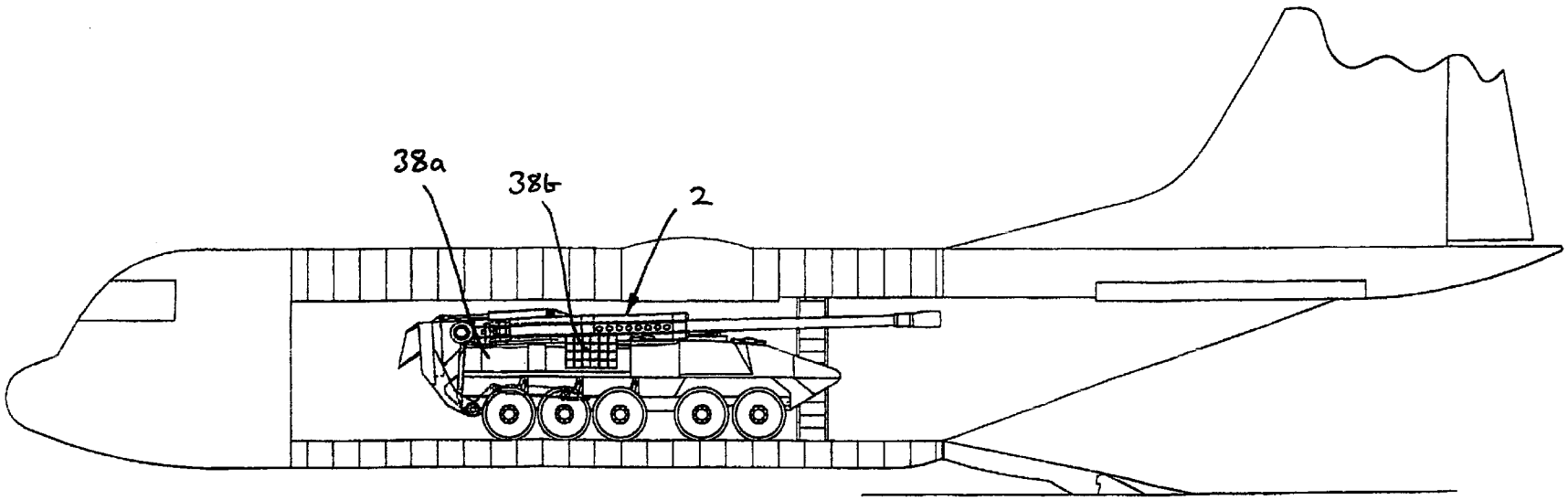
FIG. 7 is a schematic representation of the self propelled gun of the invention in the hold of an aircraft.

The powered deployment system described allows the gun assembly 8 to start being deployed automatically the instant the vehicle 4 stops. It also allows the vehicle 4 to be driven away as soon as barrel 16 comes down onto the roof of the corridor 50. This gives the SP gun 2 of the invention a level of mobility similar to that of a tank or a self propelled howitzer. However its weight, typically less than twenty tonnes when fully loaded, is substantially less than a tank making it possible to tactically deploy it by air using, for example, a short take off and landing aircraft such as a Hercules C-130 as illustrated in FIG. 7. Furthermore, due to its high mobility there is no need for heavy protective armour other than lightweight Appliqué armour along the sides of the vehicle. This is a further source of weight saving.

Since the barrel 16 is located along the axis of the vehicle in the "mobility" mode and is raised vertically when being deployed into the "firing" mode this enables the sides of the vehicle to be used for carrying ammunition.

It will be appreciated by those skilled in the art that the present invention is not limited to the specific embodiment described and that modifications can be made which are within the scope of the invention.

What is claimed is:

1. A self propelled gun comprising:

a vehicle possessing a source of primary power and a gun assembly, said gun assembly comprising:

a base;

a cradle pivotally mounted to the base about a bearing; and a barrel slidably mounted to the cradle such as to be displaceable from a first to a second position as a consequence of the barrel recoiling on firing, wherein the gun assembly is movably mounted to the vehicle such that in a first, "mobility", mode the gun assembly is free of any direct contact with the ground, and said barrel points in a first direction allowing said vehicle to be driven and a second, "firing", mode of operation in which the gun assembly is deployed to a firing position in which the base moves towards and into engagement with the ground and wherein said barrel is deployable through an angle of elevation which differs from said first direction by at least ninety degrees, said bearing is positioned at a point beyond the maximum recoil of the barrel.

2. A self propelled gun according to claim 1 in which the first direction is in a substantially horizontal forward direction.

3. A self propelled gun according to claim 1 in which the first direction is substantially coincident with a longitudinal axis of the vehicle.

4. A self propelled gun according to claim 1 in which the gun assembly is movably mounted to the vehicle by the base being pivotally attached to the vehicle by a pivot arrangement.

5. A self propelled gun according to claim 4 in which the pivot arrangement is configured such that deployment of the base into engagement with the ground raises a part of the vehicle in proximity with the pivot arrangement away from the ground.

6. A self propelled gun according to claim 1 in which the barrel is held in the second position during the "mobility" mode.

7. A self propelled gun according to claim 1 in which the barrel is held in the second position during deployment of the gun assembly from the "mobility" to "firing" mode and vice versa.

8. A self propelled gun according to claim 1 in which the cradle (14) is pivotally mounted about a bearing (18) which is positioned at a point beyond the maximum recoil of the barrel.

9. A self propelled gun according to claim 1 in which the base incorporates one or more spades.

* * * * *